United States Patent [19]

MacLean

[11] 4,190,117

[45] Feb. 26, 1980

[54] SUPPORT AND POSITIONER FOR ROCK DRILL

[76] Inventor: Donald R. MacLean, 60 Duncan St., Thornbury, Ontario, Canada, N0H 2P0

[21] Appl. No.: 941,582

[22] Filed: Sep. 12, 1978

[51] Int. Cl.[2] ..... E21C 5/00

[52] U.S. Cl. ..... 173/43; 173/38; 248/654

[58] Field of Search ..... 173/38, 43, 44; 248/2, 248/16, 654

[56] References Cited

U.S. PATENT DOCUMENTS

| | | | |
|---|---|---|---|
| 2,638,326 | 5/1953 | Lehner | 173/43 |
| 2,828,109 | 3/1958 | Dellner | 308/3.9 X |
| 3,075,754 | 1/1963 | Bles | 299/37 |
| 3,185,222 | 5/1965 | O'Leary | 173/38 X |
| 3,462,103 | 8/1969 | Strom | 173/43 X |
| 3,470,969 | 10/1969 | Arcangeli | 173/38 X |
| 3,590,930 | 7/1971 | Gronfors | 173/38 X |
| 3,604,521 | 9/1971 | Collins | 173/38 |
| 3,724,559 | 4/1973 | Stromnes | 173/38 X |
| 3,980,142 | 9/1976 | Grigorien et al. | 173/43 |
| 3,999,805 | 12/1976 | Lockwood | 173/38 X |
| 4,000,873 | 1/1977 | Wallace | 173/38 X |
| 4,022,410 | 5/1977 | Ewart et al. | 173/38 X |

*Primary Examiner*—Lawrence J. Staab

*Attorney, Agent, or Firm*—Ridout & Maybee

[57] ABSTRACT

A support and positioner for a rock drill has an extendable and retractable feed boom pivoting about a pivotal support arranged laterally below the axis of the feed boom, so that when the boom is swung downwardly to maintain a desired line of advance of the drill, the boom rocks forwardly so as to increase axial drilling thrust and the extent of forward movement of the drill, and reduce the bending stresses imposed on the drill steel.

9 Claims, 2 Drawing Figures

SUPPORT AND POSITIONER FOR ROCK DRILL

BACKGROUND OF THE INVENTION

This invention relates to a support and positioner for a rock drill.

U.S. Pat. No. 3,185,222 in the name P. C. O'Leary dated May 25, 1965 describes an extendable and retractable mounting for rock drills having upper and lower air pressure cylinders pivotally connected on a base e.g. a jumbo. The piston of the lower cylinder which acts as a feed boom, carries at its free end a mounting on which a rock drill is pivotally secured. In operation, compressed air is admitted to the upper pressure cylinder which acts as a counterbalance for the weight of the rock drill and feed boom cylinder. This facilitates the positioning of the rock drill at a desired elevation, but it is still necessary for the drilling operative to manually lift the drill to the desired elevation. With the operative then holding the drill steady at the desired position and angle of attack, the operative opens a valve admitting air to the upwardly inclining feed boom cylinder, so this is extended, feeding the rock drill forwardly along an upwardly inclined line of action towards the rock face. As the operative guides the drill forwardly, the feed boom piston and cylinder are swung progressively downwardly by hand, in order to compensate for the upward component of the motion of the feed boom piston as it progressively advances towards an extended position, in order to maintain the advance of the drill bit along a predetermined horizontal line of advance.

SUMMARY OF THE INVENTION

With the above arrangement, the drilling operation is not conducted as efficiently as it might be, since the weight of the drill and the feed boom exert a downward moment about the lower pivot point which tends to cause binding of the drill steel in the hole. To avoid this, it is necessary to maintain a positive pressure in the counter-balancing cylinder, but this also imparts a horizontal rearward component of force to the drill so that the axially forwardly-directed drilling thrust is reduced. Moreover, the progressive downward swinging of the feed boom cylinder during the drilling operation limits the maximum extent of forward advancement of the drill since, particularly when the drilling is commenced at a relatively high position on the rock face, and the feed boom is initially positioned at a steep angle of inclination, the limit of advancement of the drill may be reached before the full depth of drill hole has been completed, so that is is necessary to withdraw the drill steel from the hole, and substitute a longer drill steel before recommencing drilling. This invention provides apparatus whereby the above disadvantages may be reduced or avoided, and wherein the feed boom is connected to a linkage pivoting around a lower pivot point, below the axis of the feed boom piston, so that on downward rocking of the feed boom cylinder, the piston and cylinder rock bodily downwardly and forwardly about the lower pivot point. Owing to the forward rocking motion, an augmented axial drilling thrust is applied on the drill steel at all times with reduced bending stress on the steel. Moreover, this motion imparts an increased forward drilling range for the drill, when the drilling is conducted with the feed boom raised to an angle inclined upwardly from the horizontal.

BRIEF DESCRIPTION OF THE DRAWINGS

An embodiment of the invention, and the above-mentioned and further advantages thereof, will now be described in more detail with reference to the accompanying drawings in which.

DESCRIPTION OF THE PREFERRED EMBODIMENT

Figures 1, 2:
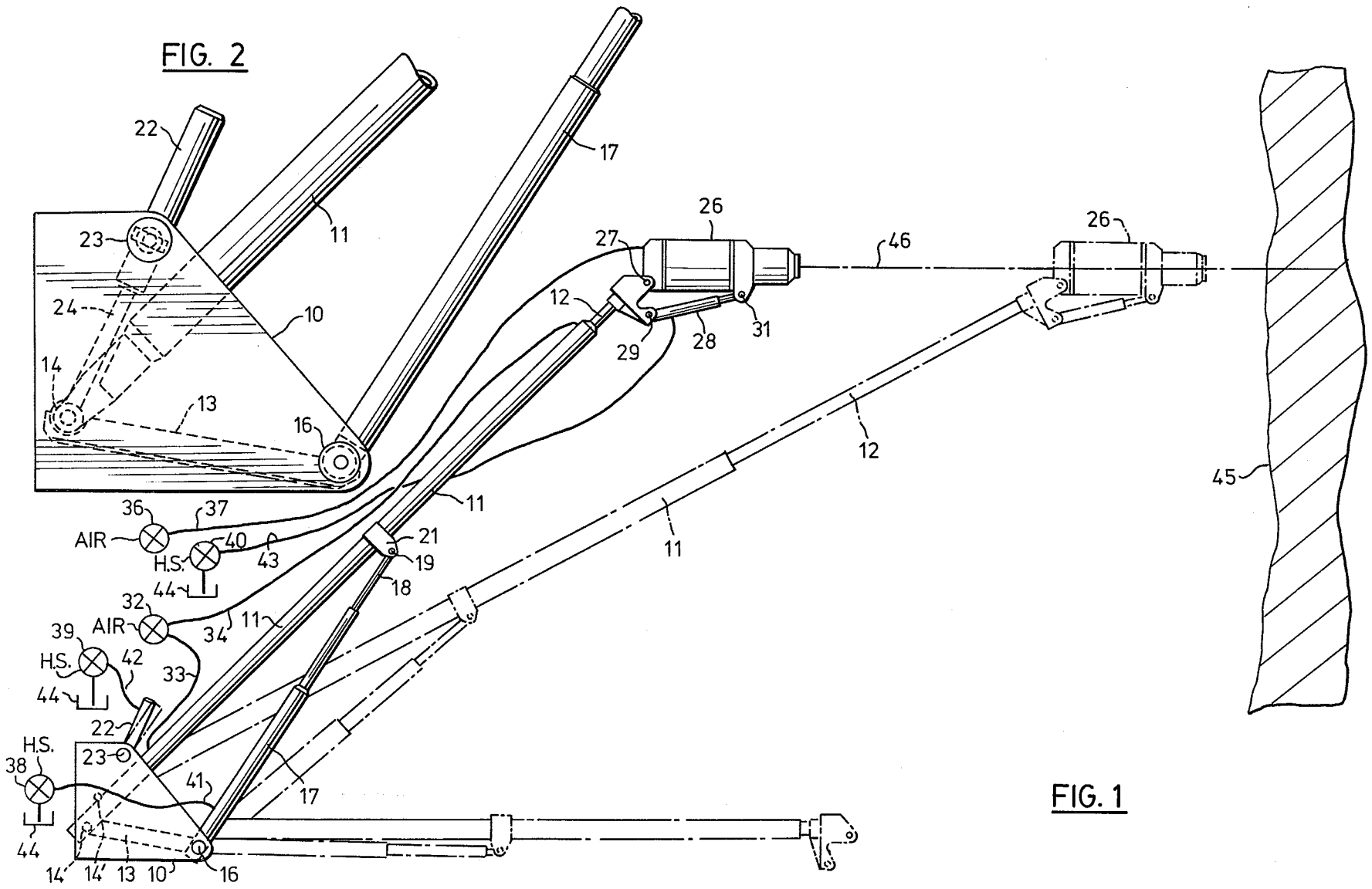
FIG. 1 is a side view of a rock drill support and positioner in accordance with the invention.
FIG. 2 is a view on an enlarged scale of the lower portion of the support and positioner.

The drill support and positioner is intended to be mounted on a mobile carrier or jumbo, and for this purpose there is provided a supporting base which is adapted to be secured on the platform of the carrier or jumbo. The base comprises two spaced vertical side plates, between which extend horizontal shafts constituting pivotal connection points for the pivoting members of the support and positioner. One of these side plates 10 is visible in the accompanying drawings.

A feed boom for the drill is constituted by a cylinder 11 and a piston 12 working in the cylinder. The lower end of the feed boom cylinder 11 is connected to a rocking linkage constituted by a bar 13. The pivotal connection between the bar 13 and the cylinder 11 is indicated at 14. The bar 13 is pivotally connected to the base plate 10 at a lower pivot point 16. A boom elevating ram 17 is connected in common with the bar 13 on the pivot 16. The piston 18 of the boom elevating ram is pivotally connected at 19 on a clamp 21 secured on an intermediate part of the feed boom cylinder 11. A boom-controlling ram 22 is pivotally connected on the base plate 10 at an upper pivot point 23. The piston of the ram 22 is connected in common with the cylinder 11 on the bar 13 at the pivot point 14.

A rock drill 26 is connected on the upper end of the feed boom piston 12 through a pivotal mounting 27. A drill-positioning ram 28 is connected between pivotal mounting points 29 and 31 on the feed boom piston 12 and drill 26, respectively. Desirably, the feed boom 11 is powered by compressed air and the boom may be supplied from the source used for powering the air-driven drill 26. The air source is connected through a valve 32 operable to direct air selectively to lines 33 and 34 connected at lower and upper ends of feed boom cylinder 11, whereby the piston 12 may be extended and retracted. The air source is also connected through an on/off valve 36 to a line 37 supplying air to the drill 26. Desirably, the boom-elevating and boom-controlling rams 17 and 22 and the drill-positioner ram 28 are operated by hydraulic pressure because this permits precise control over the extension and retraction of the working piston, as well as allowing the pistons, once extended to a desired position, to be held in a fixed position owing to the incompressibility of the hydraulic fluids. In the accompanying drawings, the letters H.S. indicate the hydraulic sources. Valves 38, 39 and 40 control the operation of the boom-elevating ram 17, the boom-controlling ram 22, and the feed drill-positioning ram 28, respectively. These valves are three-position valves which may be maintained in a closed position preventing flow through hydraulic lines 41, 42 and 43, thereby locking the respective arms 17, 22 and 28 in a fixed position, or may be opened to connect the flow lines 41, 42 and 43 selectively to the hydraulic source H.S. or to a sump 44, whereby the rams can be extended, or can be permitted to retract.

It will be noted that the pivot points 14, 16 and 19 form a triangle of variable geometry, and that when the elevating ram 17 is retracted, the sides of this triangle tend to close together. The lengths of the bar 13 and the ram 17 in its fully retracted condition are such that their sum is less than the distance between the pivot points 19 and 14, so that on full retraction of the ram 17, the variable triangle can be fully closed. In this closed position, the angle of inclination of the feed boom 11 to the vertical is determined by the position of the piston 24 of the boom-controlling ram 22. Normally, in the storage position of the boom, or for conveyance of the apparatus through mine passageways offering low head-room, the boom-controlling ram 22 is fully extended, in which position the pivot point 14 is slightly above the level of the lower pivot point 16, so that the boom 11 adopts an approximately horizontal position, as shown in broken lines in FIG. 1.

In operation, the support apparatus mounted on a jumbo is brought to within an appropriate distance from the rock face 45. With the valve 39 closed or in a position connecting the boom-controlling ram 22 to the hydraulic source, so that the boom-controlling piston 24 is kept fully extended, the valve 38 is opened to allow flow of hydraulic fluid from the source to the boom elevating ram 17. As the boom-elevating piston 18 is extended, the triangle formed by the boom 11, linkage 13, and boom-elevating ram 17 is opened up, so that with the linkage 13 retained in a fixed position, the boom 11 is rocked upwardly from the lowermost position shown in broken lines in FIG. 1 to an upper position, as indicated in solid lines in FIG. 1. The valve 38 is then closed, so that the ram 17 is held in a fixed extended position. The valve 38 remains closed throughout the remainder of the drilling operation, so that the variable triangle defined by the cylinder 11, linkage 13 and ram 17 is maintained in a constant configuration. The valve 40 is opened if necessary to extend the drill-positioning ram 28, which may up to this time have been connected through valve 42 to the sump 44, so that the drill 26 is raised from a drooped position to the required attitude, e.g. to a horizontal position, as indicated in FIG. 1. In this position, the tip of the elongated drill steel that is driven by the drill 26 will be adjacent the rock face 45. In FIG. 1, the intended line of horizontal advancement of the drill steel is indicated by broken line 46.

The valve 36 controlling supplied compressed air to the drill 26 is then opened, to drive the air motor and rotate the drill steel.

In order to advance the drill steel toward the rock face, the valve 32 is operated to feed compressed air along line 33 supplying air pressure to the lower end of the feed boom cylinder 11, so that the feed boom piston 12 commences a progressive upward and forward extension along its axis. The drill 26 is kept on the required line of attack, indicated in this instance by the broken horizontal line 46, by manual control of the valve 39, which is operated so as to allow controlled bleeding of hydraulic fluid from the boom-controlling ram 22. The extent of opening of the valve 39 controls the rate at which hydraulic fluid is expelled from the ram 22, permitting the boom 11 and the ram 17 and link bar 13 to tilt forwardly under their own weight about the lower pivot point 16. Thus, by controlling the degree of opening of the valve 39, the drill 26 tracks along the required horizontal line 46. During the initial few inches of penetration, termed "collaring," of the drill bit into the rock face 45, it is also important that the operative controlling the drilling should manually control the valve 40 that controls supply of hydraulic fluid to the drill-positioning ram 28, so that the drill 26 is rocked slightly upwardly relative to the line of action of the boom 11. Once the collaring stage has been completed, and the drill bit has penetrated sufficiently into the rock face, the drill steel becomes self guiding, and the operative can then open valve 39 fully so that hydraulic fluid is expelled freely from the cylinder of the boom-controlling ram 22 and valve 40 is operated to connect the drill positioning ram 28 with the unpressurized hydraulic fluid in sump 44 so that fluid is drawn freely from the sump 44 into the cylinder of ram 28 during the further forward rocking and extension of the feed boom 11 as the drill 26 proceeds horizontally forwardly toward the rock face. During this forward rocking movement, as the boom-controlling piston 24 gradually retracts into the cylinder 22, the lower end of the feed boom cylinder 11 rocks forwardly, so that the feed boom 11 and its feed boom piston 12 are rocked bodily forwardly and downwardly about the lower pivot point 16. This forward rocking motion is indicated in FIG. 1 by the intermediate position of the feed boom and drill 26 indicated in broken lines in FIG. 1. The corresponding forwardly-rocked position of the pivot point 14 at the lower end of the cylinder, is indicated at 14' in FIG. 1.

Owing to this forward rocking, the optimum drilling thrust is applied on the drill steel at all times with minimum bending stress on the steel. Also the range of forward advancement of the drill 26 is increased, thus allowing deeper holes to be drilled.

On completion of the drilling, the above procedure is reversed, and the air control valve 32 is operated so as to supply air to the upper air line 34, causing the feed boom piston 12 to progressively retract into the feed boom cylinder 11. The hydraulic control valves 39 and 40 are operated so as to feed hydraulic fluid to the boom-controlling cylinder 22 from the hydraulic source and to allow bleeding of fluid from the drill-positioning ram 28 to the sump 44. The piston 24 of the boom-controlling ram 22 is thereby progressively extended and the boom 11 rocks upwardly and rearwardly about the lower pivot point 16 during the withdrawal of the drill bit from the rock face, while the drill-positioning ram 28 is progressively retracted.

Once the drill bit is withdrawn from the drill hole, the valve 39 may be closed so as to retain the boom-controlling ram 22 in an extended position. The valve 38 can then be operated to extend the boom-elevating ram 17 or to permit it to retract under the pressure of the weight of the boom 11, so as to elevate or lower the feed boom 11 to a fresh drilling position or allow it to swing downwardly to the lowermost storage position indicated in broken lines in FIG. 1.

It should be noted that with the support and positioner apparatus shown in the drawings, the pneumatic and hydraulic control valves 32, 36, 38, 39 and 40 can be conveniently grouped adjacent the base plate 10, so that the positioning and functions of the drill 26 can be controlled by a single operator. It is an important advantage of the apparatus that the hydraulic ram 17, 22 and 28 permit precise positioning of the drill body and close control of its movement from a remote point, without the operator needing to handle the drill 26.

In addition to allowing the operator to drill at higher positions without needing to undertake laborious manual lifting of the drill on ladders and platforms, this avoids the operator being exposed to falling rock hazards and the deleterious effects of noise, dust, and vibration and of water jets that are usually associated with the drill and are intended to reduce the dust nuisance.

Since the capacity of the hydraulic cylinders of the boom-controlling ram 22 and the drill-positioning ram 28 are relatively small, it will be convenient to employ handoperated hydraulic pumps connected to the control valves 39 and 40 respectively as the sources of hydraulic fluid H.S. An air-driven hydraulic pump may be employed to feed hydraulic fluid to the boom-elevating ram 17.

It may be noted that in comparison with alternative arrangements in which the link bar 13 is secured non-pivotally to the feed boom cylinder 11 and the boom-elevating ram 17 is pivoted at a point spaced from the lower point of pivotal connection 16 of the link bar 13, the arrangement illustrated in the accompanying drawings provides for upward elevation of the feed boom over a large range of elevated drilling positions, while at the same time, allowing the boom to be collapsed to a substantially horizontal lower position allowing the apparatus to be transported through mine passageways offering relatively low head room space.

I claim:

1. Support and positioner apparatus for a rock drill comprising a feed boom pressure cylinder and piston, means for selectively applying fluid pressure at the upper and lower ends of the pressure cylinder whereby the piston can be extended and retracted along its axis, a mounting for a rock drill pivotally connected on the upper end of the feed boom piston, a base plate adapted for connection on a mobile carrier, a boom-elevating extendable and retractable pressure cylinder and piston pivotally connected between the base plate and an intermediate part of the feed boom cylinder, a valve controlling flow of pressure fluid to and from the elevating cylinder whereby the feed boom cylinder can be raised to an elevated angle of inclination and can be lowered, a linkage pivotally connected on a lower end of the feed boom cylinder and extending downwardly from the feed boom cylinder and laterally of the axis of the feed boom piston to a lower pivot point on the base plate located laterally of and below the axis of the feed boom piston and means retaining said linkage at a predetermined angle to said axis, said feed boom piston and cylinder rocking bodily downwardly and forwardly about said lower pivot point.

2. Apparatus as claimed in claim 1 wherein said elevating cylinder and piston constitute said retaining means and are connected between the boom cylinder and said linkage, and including means controlling rocking of said boom cylinder about the lower pivot point.

3. Apparatus as claimed in claim 2 in which the elevating cylinder and piston are pivoted on the lower pivot point and the distance between the connections of the boom cylinder to said linkage and elevating cylinder and piston, respectively, is at least equal to the combined lengths of said linkage and said boom-elevating piston when retracted, whereby when said elevating piston is retracted, said boom is swung downwardly to a position adjacent said linkage and said elevating cylinder and piston.

4. Apparatus as claimed in claim 3 including a boom-controlling pressure cylinder and piston pivotally connected between the base plate and said linkage, said feed-boom cylinder and piston extending substantially horizontal when said boom-controlling pressure cylinder and piston is fully extended and said boom-elevating piston is fully retracted.

5. Apparatus as claimed in claim 2 wherein said controlling means comprise a rocking boom-controlling pressure cylinder and piston pivotally connected between said linkage and said base plate, and valve means controlling flow of pressure fluid to and from said cylinder.

6. Apparatus as claimed in claim 5 wherein said rocking cylinder and piston are connected to the point of pivotal connection between said linkage and boom cylinder.

7. Apparatus as claimed in claim 5 wherein said feed boom cylinder is operated by compressed air and said elevating cylinder and boom-controlling cylinder are hydraulically-operated.

8. A support and positioner as claimed in claim 5 wherein the piston of said boom-controlling cylinder extends downwardly whereby fluid is expelled from the cylinder when the linkage pivots upwardly.

9. Apparatus as claimed in claim 1 and provided with a drill motor body pivoted directly on the upper end of said boom piston, a drill-positioning pressure cylinder and piston pivotally connected between the boom piston and the motor body, and valve means for controlling flow of pressure fluid to and from the cylinder.

* * * * *